US007766001B2

(12) United States Patent
Gentischer et al.

(10) Patent No.: US 7,766,001 B2
(45) Date of Patent: Aug. 3, 2010

(54) DEVICE AND METHOD FOR POSITIONING AND BLOCKING THIN SUBSTRATES ON A CUT SUBSTRATE BLOCK

(75) Inventors: Josef Gentischer, Weinstadt (DE); Dirk Habermann, Kirchzarten (DE)

(73) Assignee: Schmid Technology Systems GmbH, Niedereschach (DE)

( * ) Notice: Subject to any disclaimer, the term of this patent is extended or adjusted under 35 U.S.C. 154(b) by 355 days.

(21) Appl. No.: 11/921,958

(22) PCT Filed: May 26, 2006

(86) PCT No.: PCT/EP2006/005037

§ 371 (c)(1),
(2), (4) Date: Dec. 11, 2007

(87) PCT Pub. No.: WO2006/133798

PCT Pub. Date: Dec. 21, 2006

(65) Prior Publication Data

US 2009/0232627 A1 Sep. 17, 2009

(30) Foreign Application Priority Data

Jun. 13, 2005 (DE) ..... 10 2005 028 112

(51) Int. Cl.
*B28D 7/04* (2006.01)
*B26D 7/32* (2006.01)
*B65D 85/62* (2006.01)

(52) U.S. Cl. ..... 125/12; 125/36; 83/27; 83/417; 206/711

(58) Field of Classification Search ..... 125/12, 125/36; 83/27, 417; 206/711
See application file for complete search history.

(56) References Cited

U.S. PATENT DOCUMENTS

| | | | | |
|---|---|---|---|---|
| 5,715,806 | A * | 2/1998 | Tonegawa et al. | 125/16.02 |
| 6,416,587 | B1 | 7/2002 | Lu | |
| 2004/0159316 | A1 * | 8/2004 | Muller et al. | 125/16.02 |

FOREIGN PATENT DOCUMENTS

| | | | |
|---|---|---|---|
| DE | 199 00 671 | A1 | 7/2000 |
| DE | 199 04 834 | A1 | 8/2000 |
| DE | 102 10 271 | A1 | 10/2003 |
| DE | 198 81 310 | B4 | 9/2004 |

* cited by examiner

*Primary Examiner*—Evan Pert
(74) *Attorney, Agent, or Firm*—Bacon & Thomas, PLLC

(57) ABSTRACT

A device for positioning and blocking thin silicon wafers after wire-sawing a silicon wafer block. The device comprises a cassette that accommodates the wafer block and is provided with two contact strips whose sides facing the wafer block encompass elements which engage into narrow cutting gap between the wafers so as to maintain a distance and provide support. This allows the wafers to be fixed in the position thereof even after removing a supporting glass plate such that particularly the gap in the area of the former connecting point to the removed supporting glass plate is maintained and the subsequent singulation process is simplified.

21 Claims, 3 Drawing Sheets

DEVICE AND METHOD FOR POSITIONING AND BLOCKING THIN SUBSTRATES ON A CUT SUBSTRATE BLOCK

TECHNICAL FIELD

The present invention relates to a device and a method for positioning and blocking thin substrates, preferably silicon wafers, after the cutting, preferably wire-sawing, of the substrate block, preferably a silicon wafer block.

BACKGROUND DISCUSSION

Especially used in photovoltaic cells, very thin wafers, less than 0.3 mm thick, are cut from silicon blocks using wire saws. For this purpose, the wafer block is first glued to a supporting glass plate, which in turn is attached to a machine support board. A multitude of saw wires penetrate the wafer block simultaneously and cut down to the glass in the supporting glass plate. As a result, the individual wafers are only still secured at a glue joint that corresponds to the thickness of the wafer. The saw gap is maintained at this location. Because for the subsequent process it is necessary to keep the wafers continuously moist, the latter due to the liquid stick together in groups in areas away from the supporting glass plate. For subsequent processing, it is necessary to detach the wafers from the glue joint and to separate them. Mass production requires this process to be automated. The goal of every automated manufacturing process is to maintain an existing sequence and position.

In accordance with one device, which is known from DE 199 04 834 A1, the cut wafer block is kept submerged in liquid on a support arm of a lifting mechanism not in a hanging but in a horizontal lying position. In the process, the individual wafers at their free end tilt away from their horizontal position about the glue joint with the supporting glass plate, so that they stick to the wafer below them. If the wafers are separated from the supporting glass plate little by little, they encounter the wafer below them over their entire surface, which makes separating them even more difficult.

SUMMARY OF THE INVENTION

The objective of the present invention is therefore to create a device and a method for positioning and blocking thin substrates, in particular silicon wafers of the aforementioned type, in accordance with which, the wafers are fixed in position even after being separated from the supporting glass plate, and the gap is maintained specifically in the area of the connecting point to the supporting glass plate, which is subsequently removed, thus making the subsequent separating process simpler.

In order to achieve this objective, in a device and a method of the aforementioned type a cassette is provided that receives the wafer block along with two or more contact strips having sides, facing the wafer block. The contact strips are provided with elements which engage in the narrow cutting gap between wafers in a distancing and supporting manner. The method comprises the steps of: inserting the cut wafer block into the cassette while hanging from a supporting glass plate holding the cut wafer block along both side surfaces by first distancing and supporting elements, which penetrate into the saw gap between the individual wafers, and moving the supporting glass plate from the upper side of the cut wafer block.

As a result of the measures according to the invention, the distance between the separate wafers is maintained after the cutting of the wafer block, as is the position of the individual wafers at least in the area of the connecting point to the supporting glass plate, even after the latter is removed. In this way, the wafers from the cut wafer block can be separated or individually removed more simply and rapidly.

The lateral contact strips which are situated opposite each other, with their distancing and supporting elements in the upper area of the cassette, engage in areas of the cutting gaps between the side edges of the wafers of the cut wafer block that is inserted into the cassette while hanging from the supporting glass plate that faces the base of the cassette; enable the wafers initially to be kept at a distance from each other on both side edges of the wafer block in the vicinity of the connecting point, even if the individual wafers are in contact with each other at their lower edges facing away from the supporting glass plate.

Advantageously, lateral contact strips having their distancing and supporting elements horizontally engaged in, or pivoted into, the cutting gaps are provided so that the gaps between the wafers can be maintained in a simple manner.

In accordance with the provision of protective bars for the wafer end edges that face away from the supporting glass plate the height of the wafer block within the cassette can be fixed in a simple manner.

The features wherein the cassette is provided with lateral guide bars for the wafer side edges, permits the fixed insertion of the wafer block into the cassette.

The features wherein one or more upper contact strips, situated next to each other, can be arranged with their distancing and supporting elements facing away from the base of the cassette and engaged in areas of the cutting gaps between the upper edges of the wafers of the cut wafer block that is detached from the supporting glass plate, are provided in accordance with one preferred embodiment. In this way, it is possible to also maintain a distance between individual wafers in the area of the upper end edge after the removal of the supporting glass plate. In this context, it can be expedient in addition to the upper contact strips also to have additional upper guide bars to make the subsequent processing and manipulation of the cut wafer block within the cassette easier.

It is expedient to provide that the upper contact strip and the upper guide bar can be moved towards the upper edges of the wafers of the wafer block after the removal of the supporting glass plate in order that, along with separating and removing the supporting glass plate, the cut wafer block at the same time is furnished with upper contact strips and upper guide bars. If it is necessary to separate and remove the wafers from the cassette in a lateral direction or, after a 90° rotation, in the vertical direction, the features whereby one of the two lateral guide bars and one of the two side contact strips facing each other with their distancing and supporting elements can be removed for opening the side of the cassette are provided, which means that the cassette, after being closed from the upper side, is now opened on one of the side edges. On account of potential grooves in the wafer surfaces caused by the wire saw, the process of separating and removing the wafers from the cassette is thus simplified.

Advantageous embodiments with respect to the contact strips that keep the wafers at a distance from each other are provided by the distancing and supporting element as an elastic profile having pointed, triangular attachments, or configured it as an elastic lamella, or by being made of a plastic bead, or by configuring it as a brush bar. According to a further exemplary embodiment, wherein a large-surface spray device is arranged above the upper edges of the wafers of the wafer block that has been detached from the supporting glass plate the distancing effect of the contact strips are increased.

The features by which a vacuum tweezer is provided on one side of the cut wafer block within the cassette, and/or by which the vacuum tweezer can be moved in the vertical or horizontal direction to remove a wafer from the cassette make it possible to separate and remove the wafers from the cassette, either in the vertical or horizontal direction, depending on whether the upper side of the cassette or one of the longitudinal sides of the turned-over or rotated cassette is and remains opened.

In accordance with the feature of individually removing wafers in the vertical direction from the cut wafer block after the removal of the supporting glass plate, the separate wafers can be removed individually, for example, in a direction opposite to that for inserting the cut wafer block.

In the method that is preferably used, the wafers are advantageously separated and removed from the cut wafer block in a direction that accords with the direction of the grooves on the surfaces of the individual wafers that are created during the cutting, i.e., with the wire sawing of the wafer block, which guarantees that the motion during the separating and removal of individual wafers will be not produce friction and serrations. This can occur either in the lateral, i.e., horizontal direction or, after a 90° rotation, in the vertical direction, so that the point of reference for the insertion of the wafer block remains the same.

The separating process is made simpler as a result of sprinkling the cut wafer block from its upper side with a liquid.

Further details of the present invention can be derived from the following description, in which the invention is discussed in greater detail on the basis of the exemplary embodiments that are depicted in the drawing.

DETAILED DESCRIPTION

Figure 1:
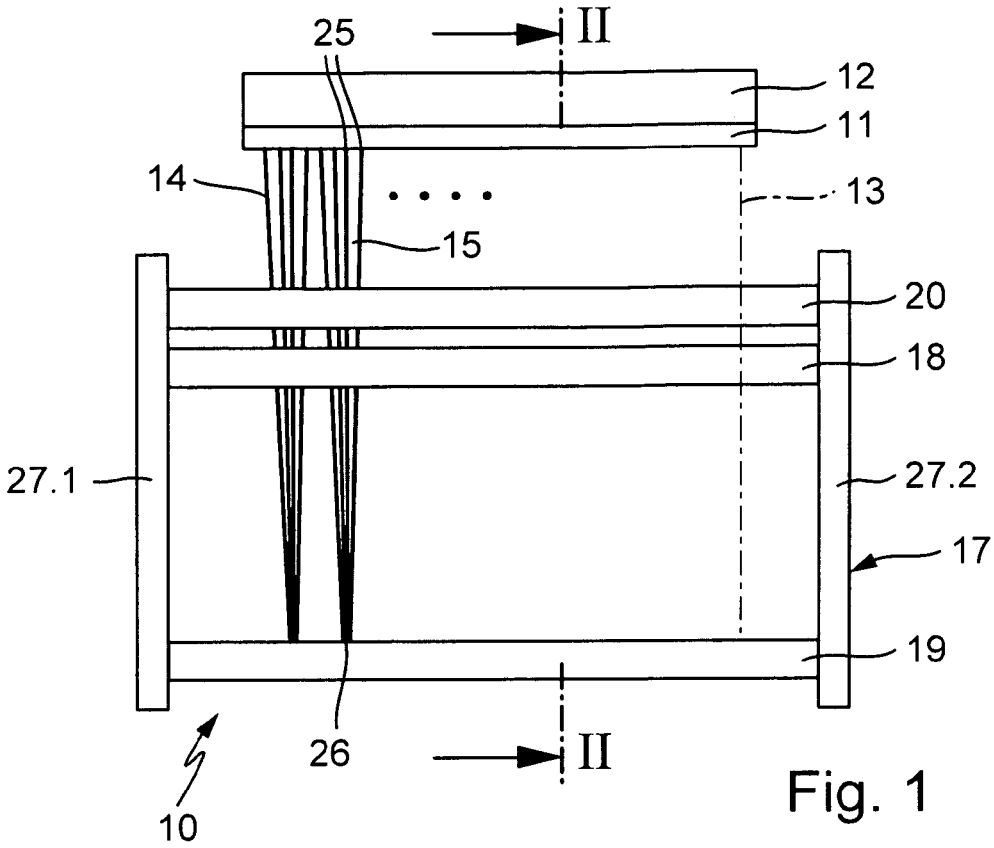
FIG. 1 is a schematic front view, which depicts a cut wafer block, as it is received in a fixing cassette, still joined to a supporting glass plate.
Figure 2:
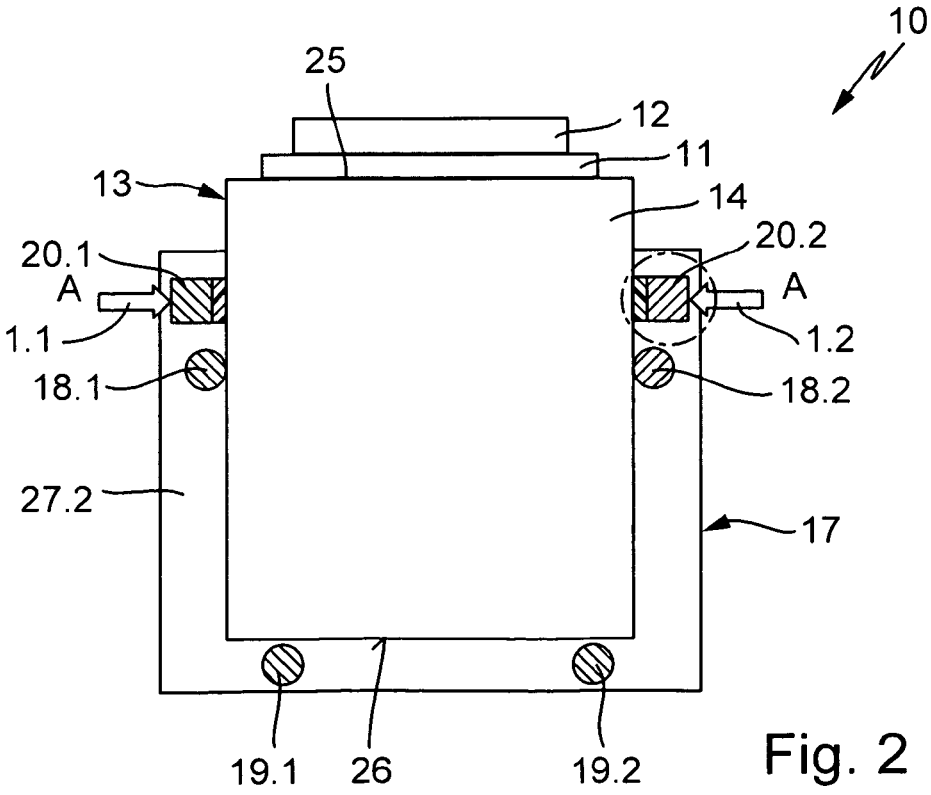
FIG. 2 depicts a cutaway view along the line II-II of FIG. 1.

Device 10, or 10', depicted in the drawing in two exemplary embodiments, functions to position and to block thin substrates, preferably thin silicon wafers 14, after the cutting, preferably wire-sawing, of a substrate block, preferably a silicon wafer block 13. Wafer block 13, together with a still glued supporting glass plate 11, which is attached to a machine support board 12, is cut using wire saws into uniform thin wafers 14, of a maximum 0.3 mm thickness, by cutting down to the surface of supporting glass plate 11. Device 10, or 10', in this context separates wafers 14 from wafer block 13 simply and rapidly and conveys them for further processing.

Wafers 14 from cut wafer block 13 are inserted into a cassette 17 while hanging from supporting glass plate 11. In this context, wafers 14 at their connecting glue points 25 are still arranged at a distance from each other resulting from saw gap 15, whereas in the area of their lower edges 26 away from connecting glue points 25, they stick to adjacent wafers in groups (FIG. 1).

Cassette 17 has a U-shaped cross-section and is open on its upper side, and at both ends a U-shaped frame part 27.1 and 27.2 is provided which is arranged parallel to wafers 14, and their saw gaps 15. The distance between both frame parts 27.1 and 27.2 is somewhat greater than the dimensions of wafer block 13, and of supporting glass plate 11. Both frame parts 27.1 and 27.2 are held apart, on the one hand, by lateral guide bars 18.1 and 18.2 that are designed as round bars and, on the other hand, by support bars 19.1 and 19.2 located on the base and also configured as round bars. The distance between guide bars 18.1 and 18.2, arranged opposite each other, in the upper area of frame parts 27.1 and 27.2 corresponds to the width of wafers 14 and of wafer block 13, so that cut wafer block 13 can be inserted successfully from the upper side of cassette 17 and guided into the interior space of the cassette. Base-side support bars 19.1 and 19.2 provide support for lower edges 26 of wafers 14 and therefore have a corresponding horizontal distance from each other. Wafer block 13 lies within cassette 17 over most of its length.

In an upper area of both frame parts 27.1 and 27.2 and above both guide bars 18.1 and 18.2, contact strips 20.1 and 20.2, situated opposite each other, are supported so that they can move in the horizontal direction. Contact strips 20.1 and 20.2, which are supported so as to be able to move towards each other in the direction of arrow A, aid in positioning and blocking wafers 14 that are supported while hanging from supporting glass plate 11 and thus also aid in fixing, or maintaining, saw gap 15 between wafers 14 in an area below connecting glue points 25. When cut wafer block 13, hanging from supporting glass plate 11, is inserted into cassette 17, contact strips 20.1 and 20.2 are moved towards side edges 28 of wafers 14 in the direction of arrow A, so that wafers 14 are kept at a distance from each other in this area in a manner depicted in FIG. 1.

Contact strips 20.1 and 20.2 can be designed in various ways as depicted in FIGS. 3 to 6. Each contact strip 20 has attachments 32, 33, 34, and 36 that face wafer block 13 and wafers 14 and that are able to exert pressure and to protrude into thin saw gap 15 that is still present in this area, therefore keeping wafers 14 at this location at a distance from each other, and to provide them with lateral support, when in a subsequent step, supporting glass plate 11, along with machine support board 12, is taken away or removed after the glue at connecting glue points 25 has been dissolved and removed.

Figure 3:
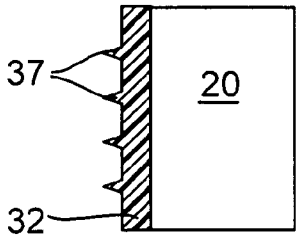
FIGS. 3 to 6 depict various embodiments of the distancing and supporting contact strips in an enlarged representation.
Figure 4:
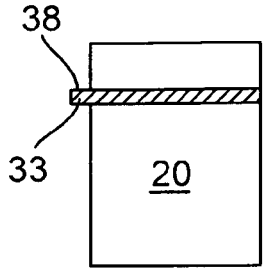
Figure 5:
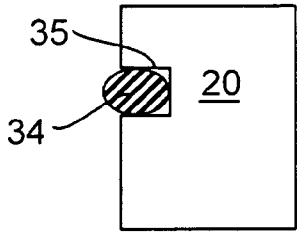
Figure 6:
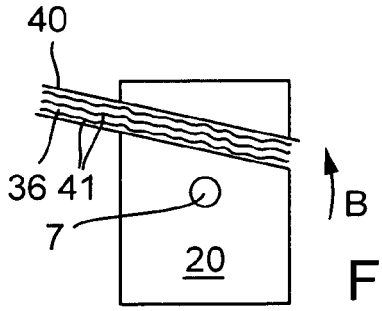

According to FIG. 3, elastic attachment 32 possesses horizontal, triangular or wedge-shaped separating elements 37 that project forward and are arranged at a distance from each other. According to FIG. 4, attachment 33 has an elastic lamella 38 as a distancing and supporting element. According to FIG. 5, attachment 34 is designed in the shape of a plastic bead 39, which is introduced in a groove of contact strip 20 and protrudes beyond the latter's forward edge. When either lamella 38 or bead 39 is pressed against side edges 28 of wafers 14, lamella 38 or bead 39 is deformed in such a way that it is pressed into areas between wafers 14, i.e., into saw gaps 15. According to FIG. 6, attachment 36 has a brush strip 40, which by pivoting contact strip 20 in the direction of arrow B is brought into contact with side edges 28 of wafers 14 such that in some areas bristles 41 extend into saw gaps 15.

Figure 7:
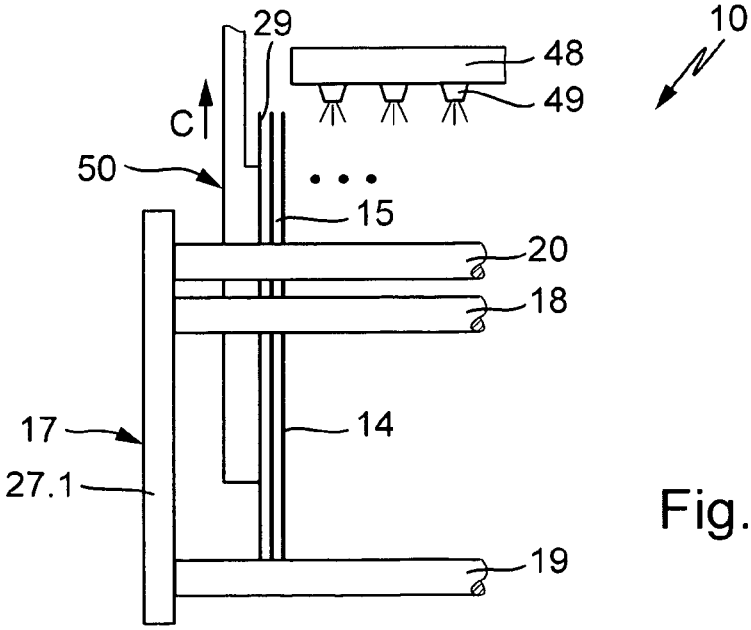
FIG. 7 is a front view, which depicts the wafer block that has been separated from the supporting glass plate, standing in the cassette along with a spraying device that is arranged over the individual wafers, and with a vacuum tweezer for achieving separation from the cut wafer block and for removing the wafers from the cassette in accordance with a first exemplary embodiment of the present invention.

As soon as contact strips 20.1 and 20.2, which can be arranged in numbers one over the other, are placed in position, supporting glass plate 11, as already mentioned, is separated from wafers 14 in its entirety, as can be seen from FIG. 7. Thereupon, a spray device 48 that is provided with a multiplicity of nozzle elements 49 is placed in position above upper edge 29 of wafers 14. Spray device 48 sprinkles wafers 14 with a liquid which penetrates into saw gaps 15 in the area of the upper edges of wafers 14, and therefore wafers 14 along their lower edge, at which wafers 14 stick together in groups, are opened, so that a small gap is created there as well.

Arranged adjacent to one of frame parts 27.1 and 27.2 is a vacuum tweezer 50, which can grip individual wafers 14, separate them, and remove them from the cut block. In the exemplary embodiment depicted in FIG. 7, this occurs in the direction of arrow C, i.e., beyond the open upper side of cassette 17.

Figure 8:
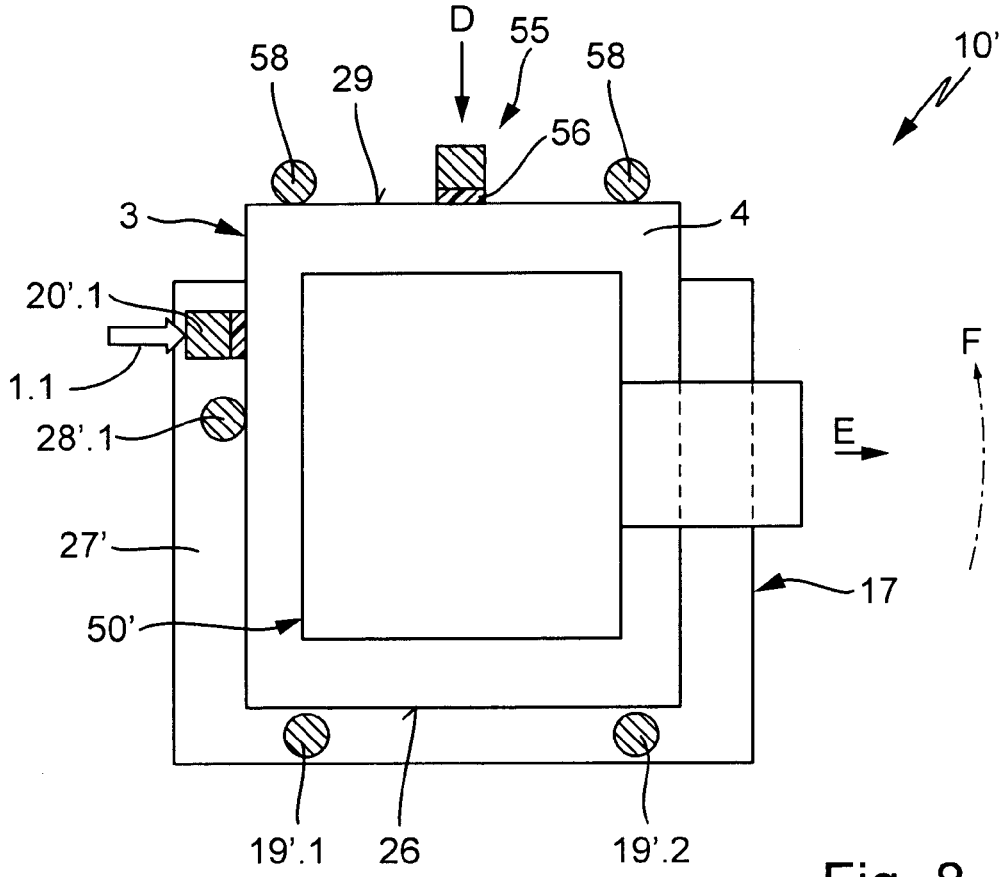
FIG. 8 depicts a cutaway view corresponding to FIG. 2, but in accordance with a second exemplary embodiment of the present invention.

FIG. 8 depicts a second preferred embodiment of the present invention. In device 10', cassette 17' is essentially designed in the same manner, i.e., is provided with frame parts 27'.1 and 27'.2, guide bars 18'.1 and 18'.2, support bars 19'.1 and 19'.2, and contact strips 20'.1 and 20'.2 that are arranged in the upper area of cassette 17 and above guide bars 18'.

Also, in the case of this exemplary embodiment, in accordance with FIG. 1, wafers 14, which are formed by cutting (wire sawing) wafer block 13 while hanging from supporting glass plate 11 at connecting glue points 25, are inserted through the side of cassette 17', open to the top, and into said cassette, until they rest upon support bars 19'.1 and 19'.2. As soon as contact strips 20'.1 and 20'.2 are placed in their distancing and supporting positions with respect to wafers 14, and as soon as supporting glass plate 11, together with machine support board 12, is removed from upper edges 29 of wafers 14 and is removed from the area of cassette 17', one or more upper contact strips 55, arranged next to each other, are placed above upper edges 29 of wafers 14 and, vertically according to arrow D, are placed upon the wafers such that upper edges 29 of wafers 14 are maintained in their position. These one or more upper contact strips 55 can have a configuration corresponding to contact strips 20'; in any case, they are configured in such a way that they have distancing and supporting attachments 56 which maintain saw gaps 15 in this upper area.

In addition to these upper contact strips 55, one or more additional upper guide bars 58' can be arranged so as to be adjoining. Between upper contact strips 55 and upper guide bars 58, it is possible, in an undepicted manner, to arrange a spray device 48 having nozzles 49, which function to sprinkle a liquid into saw gaps 15 in order to open, or to separate, wafers 14 that stick to each other in the area of their lower edge 26.

In order to separate as well as remove and take out wafers 14 from cassette 17', cassette 17' is opened on one of two side areas. For this purpose, for example, guide bar 18'.2 and contact strip 20'.2 can be removed, or they can move, from the side area of cassette 17' in such a way that this side of cassette 17' is opened. A vacuum tweezer 50' grips individual wafers 14 over a large surface. According to FIG. 8, vacuum tweezer 50' can move each individual wafer 14 horizontally in the direction of arrow E from the now open side of cassette 17'.

In an undepicted manner, however, it is more expedient if device 10', or cassette 17', is rotated 90° in accordance with the dot-dash-line arrow F, so that wafers 14 are conveyed out of cassette 17' in vertical direction 6 by vacuum tweezer 50' in accordance with the exemplary embodiment of FIG. 7, so that the reference plane, or reference point, remains the same as with the insertion of cut wafer block 13.

In both cases, individual wafers 14 move relative to each other differently than in the case of the exemplary embodiment according to FIG. 7, in a direction parallel to the grooves that arise on the surfaces of wafers 14 as a result of the wire sawing process. In accordance with the exemplary embodiment in FIG. 7, the motion of wafers 14 is carried out with the assistance of vacuum tweezer 50 diagonally with respect to the direction of any grooves appearing in the wafer surfaces, which results in wafers rubbing against each other, thus hampering the separation process. The extraction of wafers 14 using vacuum tweezer 50' from cassette 17' is guided and made easier by support bars 19'.1, 19'.2, situated opposite each other, and by the at least one upper guide bar 58'.

Clearly, device 10', or cassette 17' can also be rotated before the opening of a side, i.e., guide bar 18'.2 and contact strip 20'.2 are only removed after the 90° rotation in order to open cassette 17'.

The invention claimed is:

1. A device for positioning and blocking thin substrates, preferably silicon wafers, after cutting, preferably wire sawing, of a substrate block, preferably a silicon wafer block, comprising:

a cassette that receives the wafer block; and two or more contact strips provided with said cassette, having sides, facing the wafer block, provided with elements, which engage narrow cutting gaps between the wafers in a distancing and supporting manner.

2. The device as recited in claim 1, further comprising:

a supporting glass plate, said two or more contact strips are lateral contact strips, which are situated opposite each other, with their said distancing and supporting elements in an upper area of said cassette;

said lateral contact strips engage in areas of the cutting gaps between the side edges of the wafers of the cut wafer block that is inserted into the cassette while hanging from said supporting glass plate that faces the base of the cassette.

3. The device as recited in claim 2, wherein:

said lateral contact strips having their distancing and supporting elements can be horizontally engaged in, or pivoted into, the cutting gaps.

4. The device as recited in at claim 1, wherein:

said cassette on its base side is provided with protective bars for the wafer end edges that face away from said supporting glass plate.

5. The device as recited in claim 1, wherein:

said cassette is provided with lateral guide bars for the wafer side edges.

6. The device as recited in claim 1, wherein:

one or more upper contact strips, situated next to each other, can be arranged with their distancing and supporting elements facing away from the base of said cassette and engage in areas of the cutting gaps between upper edges of the wafers of the cut wafer block that is detached from said supporting glass plate.

7. The device as recited in claim 6, wherein:

the upper edge of the wafers of the wafer block that is detached from said supporting glass plate can be covered by one or more of said upper guide bars.

8. The device as recited in claim 6, wherein:

said upper contact strip and said upper guide bar can be moved towards the upper edges of the wafers of the wafer block after the removal of said supporting glass plate.

9. The device as recited in claim 2, wherein:

one of said two lateral guide bars and one of said two side contact strips facing each other with their distancing and supporting elements can be removed for opening the side of said cassette.

10. The device as recited in claim 1, wherein:

said distancing and supporting element is designed as an elastic profile having pointed, triangular attachments.

11. The device as recited in claim 1, wherein:

said distancing and supporting element is configured as an elastic lamella.

12. The device as recited in claim 1, wherein:

said distancing and supporting element is made of a plastic bead.

13. The device as recited in claim 1, wherein:

said distancing and supporting element is configured as a brush bar.

14. The device as recited in claim 1, further comprising:

a large-surface spray device, wherein:

said large-surface spray device is arranged above the upper edges of the wafers of the wafer block that has been detached from said supporting glass plate.

15. The device as recited in claim 1, further comprising:

a vacuum tweezer, wherein:

said vacuum tweezer is provided on one side of the cut wafer block within said cassette.

16. The device as recited in claim 15, wherein:

said vacuum tweezer can be moved in the vertical or horizontal direction to remove a wafer from said cassette.

17. A method for positioning and blocking thin substrates, preferably silicon wafers, after cutting, preferably wire sawing, of a substrate block, preferably a silicon wafer block, comprising the steps of:

inserting the cut wafer block into a cassette while hanging from a supporting glass plate;

holding the cut wafer block along both side surfaces by first distancing and supporting elements, which penetrate into the saw gap between the individual wafers;

and moving the supporting glass plate from the upper side of the cut wafer block.

18. The method as recited in claim 17, wherein:

the wafers are individually removed in the vertical direction from the cut wafer block.

19. The method as recited in claim 17, wherein:

the cut wafer block along its upper edge is held by second distancing and supporting elements that penetrate into the saw gap between the individual wafers, the first distancing and supporting elements are removed at one of the two side surfaces of the cut wafer block, and the wafers are individually removed from the cut wafer block.

20. The method as recited in claim 19, wherein:

the supported wafer block is rotated 90° before or after the removal of the first elements, and the wafers are removed vertically from the cut wafer block.

21. The method as recited in claim 17, wherein:

the cut wafer block from its upper side is sprinkled with a liquid.

* * * * *